US011793284B2

(12) United States Patent
Edlund Tjernberg et al.

(10) Patent No.: US 11,793,284 B2
(45) Date of Patent: Oct. 24, 2023

(54) CONTAINER FOR STORING AND TRANSPORTING FOOD ITEMS FOR LATER CONSUMPTION

(71) Applicant: b.box for kids developments Pty Ltd, Mulgrave (AU)

(72) Inventors: Lisa Edlund Tjernberg, Mulgrave (AU); Sylvain Jacques Amatoury, Mulgrave (AU)

(73) Assignee: b.box for kids developments Pty Ltd, Notting Hill (AU)

( * ) Notice: Subject to any disclaimer, the term of this patent is extended or adjusted under 35 U.S.C. 154(b) by 46 days.

(21) Appl. No.: 17/626,431

(22) PCT Filed: Jul. 14, 2020

(86) PCT No.: PCT/AU2020/050727

§ 371 (c)(1),
(2) Date: Jan. 11, 2022

(87) PCT Pub. No.: WO2021/011995

PCT Pub. Date: Jan. 28, 2021

(65) Prior Publication Data

US 2022/0287426 A1 Sep. 15, 2022

(30) Foreign Application Priority Data

Jul. 22, 2019 (AU) ..... 2019208141

(51) Int. Cl.
*A45C 11/20* (2006.01)
*A45C 7/00* (2006.01)
(Continued)

(52) U.S. Cl.
CPC ..... *A45C 11/20* (2013.01); *A45C 7/0022* (2013.01); *A45C 13/005* (2013.01); *A45C 13/02* (2013.01); *A45C 13/1084* (2013.01)

(58) Field of Classification Search
CPC ..... A45C 11/20; A45C 7/00; A45C 7/0022; A45C 7/0036; A45C 13/02
See application file for complete search history.

(56) References Cited

U.S. PATENT DOCUMENTS 3,451,328 A 6/1969 Swett
6,260,729 B1 * 7/2001 Mitchell ..... B65D 41/22 220/780

(Continued)

FOREIGN PATENT DOCUMENTS

CN 2478954 Y 2/2002
CN 1550421 A 12/2004

(Continued)

*Primary Examiner* — Javier A Pagan
(74) *Attorney, Agent, or Firm* — Young Basile Hanlon & MacFarlane, P.C.

(57) ABSTRACT

A food container has a container bottom and a container lid. The container bottom has a base and walls upstanding from the base to define a container bottom interior. The container lid has a top cover and side edges and the top cover overlies the base when the lid is in closed connection with the bottom. The top cover includes an elastically deformable portion and an inelastic portion. Each of the elastically deformable portion and the inelastic portion overlies different portions of the base when the lid is in closed connection with the bottom. The elastically deformable portion facilitates accommodation of an item within the container bottom interior that rests on the base that underlies the elastically deformable portion and that extends into contact with the elastically deformable portion as the lid is shifted into closed connection with the bottom by deforming elastically outwardly away from the base.

20 Claims, 5 Drawing Sheets

(51) Int. Cl.

| | |
|---|---|
| ***A45C 13/00*** | (2006.01) |
| ***A45C 13/02*** | (2006.01) |
| ***A45C 13/10*** | (2006.01) |

(56) References Cited

U.S. PATENT DOCUMENTS

| | | | | |
|---|---|---|---|---|
| 7,975,868 | B1 * | 7/2011 | Flies | B65D 1/265 220/524 |
| 2006/0151496 | A1 | 7/2006 | Healy et al. | |
| 2010/0102060 | A1 | 4/2010 | Ruse, Jr. | |
| 2011/0121002 | A1 * | 5/2011 | Stiller | A45C 11/20 220/504 |

FOREIGN PATENT DOCUMENTS

| | | | | |
|---|---|---|---|---|
| EP | 0208352 | A1 * | 1/1987 | |
| EP | 0208352 | A1 | 1/1987 | |
| EP | 1468933 | A1 * | 10/2004 | B65D 43/0222 |
| EP | 1468933 | A1 | 10/2004 | |
| KR | 20050004973 | A | 1/2005 | |
| NL | 2007251 | C2 | 2/2013 | |
| NO | 084240 | | 3/2014 | |
| WO | 2004002845 | A1 | 1/2004 | |

* cited by examiner

CONTAINER FOR STORING AND TRANSPORTING FOOD ITEMS FOR LATER CONSUMPTION

PRIORITY CROSS-REFERENCE

This application is a national stage 371 application of PCT/AU2020/050727, filed Jul. 14, 2020, which claims priority to Australian Patent Application No. 2019208141 filed Jul. 22, 2019, the contents of which are incorporated into this specification by this reference.

TECHNICAL FIELD

The present invention relates to a container for storing and transporting items. The present invention has been developed as a food container for storing food items for later consumption, usually same day consumption. It will therefore be convenient to describe the invention in relation to that use. However, it is to be appreciated that the container of the invention is not limited to a food container and could be a container for containing any suitable items.

With respect to a food container, one example of the type of use to which the food container could be put is for storing the food that parents provide for the lunches and snack breaks that school age children have at school.

BACKGROUND OF THE INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Food containers for storing and transporting food items for later consumption are available. Many toddlers and school age children take a day's food for each day at pre-school or school in such containers. Likewise, many adult workers take snacks and lunch to work in food containers. Food containers used in this manner are almost exclusively made of substantially rigid plastic and comprise a base and a lid. The base normally provides the major component of the containment space for the storage of food, although the lid can also add contribute to the containment space.

The base and lid are normally connected together by a hinge at one edge and cooperating clip or latch components at the opposite edge. The clip or latch components cooperate to secure the lid in a closed condition relative to the base.

In the closed condition of the container, the height of the containment space within the container is set by the spacing between facing surfaces of the base and lid. This set height precludes storage within the container of food items that have a height that is greater than the height of the containment space. The rigid nature of the base and lid means that if a food item that has a height that is greater than the height of the containment space is to be stored in the food container, the lid must either be left ajar relative to the base to accommodate the larger food item, or the food item must be carried separately from the food container. Either outcome is often undesirable, as leaving the lid unclipped or unlatched from the base can allow the escape of food items from within the container, while carrying food items separately from the food container can mean that they are overlooked for consumption. The food item could sometimes be cut into smaller pieces although that can be undesirable as it requires more preparation and can lead to a deterioration of the visual appearance and nutritional value of the food item given that the food item might be stored for extended periods within the container.

Norwegian design registration 084240 in the name of UNIKIA AS illustrates a food container that has an outwardly projecting dome at one end. The dome potentially allows food items that do not fit inside the other parts of the container to fit in the dome part, however, the shape of the dome is fixed and so the ability to accommodate such items is limited. That is, if a square item bears against the inside surface of the dome towards the periphery of the dome, then the full height of the dome cannot be used to accommodate item. Moreover, because the dome is fixed in shape, the dome always projects from the container lid and thus permanently increases the bulk of the container. The food container of this design registration thus does not readily solve the problem of the accommodation of items that have a height that is greater than the height of the containment space of the food container.

The present invention seeks to provide a container, such as food container that overcomes or at least alleviates the above disadvantages with current containers.

SUMMARY OF THE INVENTION

According to the present invention there is provided a container, the container having:

a container bottom, and a container lid, the container bottom having a base and walls upstanding from the base to define a container bottom interior, the container lid having a top cover and side edges, the top cover overlying the base when the lid is in closed connection with the bottom, the top cover including an elastically deformable portion and an inelastic portion, each of the elastically deformable portion and the inelastic portion overlying different portions of the base when the lid is in closed connection with the bottom, the elastically deformable portion facilitating accommodation of an item within the container bottom interior that rests on the portion of the base that underlies the elastically deformable portion and that extends into contact with the elastically deformable portion as the lid is shifted into closed connection with the container bottom, by the elastically deformable portion deforming elastically outwardly away from the base in contact with the item.

A container according to the invention can advantageously facilitate the accommodation of items, such as food items, that have a height that exceeds the height of the containment space of the container, by the elastically deformable portion elastically deforming outwardly so that the height of the containment space is increased. The elastic deformation and thus the increase in containment space is temporary, as the elastically deformable portion can recover to the pre-deformed state or shape once the item that caused the elastic deformation is removed from the container. Items of this kind will hereinafter be referred to as "oversize" items.

Advantageously, with the elastic deformation of the elastically deformable portion, the oversize item can be accommodated within the container and the container lid can be closed onto the container bottom so that the container can be closed. This prevents the escape of items from within the container that might otherwise occur if the lid were left ajar relative to the container bottom in order for the oversize item to be placed within the container. Further, in containers in which the lid seals with the container bottom upon closure of the lid against the container bottom, the elastic deformation facility of the present invention to allow oversize items to be accommodated allows that seal to be made despite the existence of an oversize item within the container. This means that food items that require the container to be sealed to prevent the item from spoiling or leaking, can still be stored within the container despite an oversize item also being present in the container. Still further, in a container according to the invention the oversize item can be retained with the other items within the container, so that the oversize item is unlikely to be overlooked for consumption.

It is the intention that each of the elastically deformable portion and the inelastic portion of the top cover be spaced from the base of the container bottom when the lid is in closed connection with the container bottom, so that items are able to underlie each of those portions when the lid is shifted into closed connection with the container bottom. Thus, it is the intention that items that are placed into the container bottom interior can be placed in positions in which they underlie either of the elastically deformable portion or the inelastic portion, but where an item has a size or height that prevents or would prevent the lid being shifted into closed connection with the container bottom when the item underlies the inelastic portion, that item can be placed or relocated to underlie the elastically deformable portion, whereby closure of the lid on the container bottom might be facilitated by virtue of the outward deformation of the elastically deformable portion.

A container according to the invention can be of any suitable shape, such as generally square, rectangular, circular or oval for example. A container according to the invention can have the container lid as a removable lid, whereby it can be removed completely from the container bottom to open the container, or the lid can be permanently attached to the container bottom, such as by a hinge. The container can include suitable clip or latch arrangements to secure the lid in closed connection with the container bottom when the container is to be closed.

In a container according to the invention the container bottom can include at least one partition wall within the container bottom interior to form at least two compartments. Separate compartments allow items that are to be contained in the container to be separated from each other. For example, food items that might sweat in the container, such as previously refrigerated items e.g. fruit or drinks, can be separated from moisture absorbent food items, such as sandwiches. The container bottom interior can be divided into two compartments. Alternatively, more than two compartments can be provided. The compartments can be of equal size or of unequal size. Where more than two compartments are provided, two of the compartments can be of equal size and one or more of the compartments can be of a different size.

In the above forms of the invention, the elastically deformable portion can overlie a single one of the compartments. Alternatively, the elastically deformable portion can overlie two or more compartments. For example, the elastically deformable portion can extend across two adjacent compartments, bridging across the partition wall between the adjacent compartments. Alternatively, a first elastically deformable portion can overlie one compartment and a second elastically deformable portion can overlie another compartment, such as an adjacent compartment. Alternatively, the compartments that the first and second elastically deformable portions overlie can be spaced apart from each other by other intermediate compartments. In these forms of the invention, the first and second elastically deformable portions can be separated by an inelastic portion.

First and second elastically deformable portions can be employed even in containers in which no partition walls are provided. The first and second elastically deformable portions can simply be provided where provision is required or considered desirable to accommodate oversize items in the container.

The elastically deformable portion can have any suitable shape. The elastically deformable portion could, for example be anyone of generally square, rectangular, circular or oval for example, although circular is considered to be most appropriate as the stresses created in the elastically deformable portion upon elastic deformation will generally be created equally across the elastically deformable portion. However, the top cover can include elastically deformable portions of different shapes as may be required. For example, where the elastically deformable portion extends across two adjacent compartments, the portion can be longer than it is wide and so can be rectangular or oval.

When the elastically deformable portion is in an undeformed or resting state so that it has not been engaged by an oversize item during closure of the container lid on the container bottom, the elastically deformable portion can have a generally planar form. In this form of the invention, the elastically deformable portion deforms outwardly, by the material of the portion stretching. Alternatively, the elastically deformable portion can be formed to have a generally corrugated cross-section in the undeformed or resting state. For a circular elastically deformable portion, the corrugations can be formed as increasing diameter circles. In this latter form of the invention, as the elastically deformable portion deforms outwardly, the corrugated cross-section will itself deform with the corrugations becoming more shallow until the corrugations have disappeared. Further deformation of the elastically deformable portion can then take place by the material of the portion stretching. The corrugated cross-section is one example of a non-planar form of elastically deformable portion and other non-planar forms are within the scope of the present invention.

The elastically deformable portion and the inelastic portion can be formed in the top cover of the container lid in any suitable manner. For example, the elastically deformable portion and the inelastic portion can be formed integrally. This can be achieved by the elastically deformable portion being formed of the same material as the inelastic portion but with the elastically deformable portion having a thinned wall section compared to the inelastic portion. For example, the common material of the elastic and inelastic portions could be polypropylene and the wall thickness of the inelastic portion could be in the region of over 2 to 4 mm, while the wall thickness of the elastically deformable portion could be in the region of 0.2 to 1 mm. This form of the invention can be produced by the top cover being formed by moulding.

Alternatively, the elastically deformable portion and the inelastic portion can be formed separately. This form of the invention can also be produced by the top cover being formed by moulding, whereby the moulding process is by overmoulding two separate materials, one being for the elastically deformable portion and the other being for the inelastic portion.

In other forms of the invention, the top cover comprises a substrate of inelastic material to form the inelastic portion of the top cover and forming an opening in the substrate for receipt of the elastically deformable portion. The opening can be a circular opening, or any other suitable shape of opening such as a square, rectangular or oval opening, suitable to form the shape of elastically deformable portion required. In this form of the invention, the elastically deformable portion can extend across the opening such as from above the opening, or below the opening or the elastically deformable portion can connect to the opening, such as to the rim of the opening.

While the elastically deformable portion can connect just to the rim of the opening, in alternative arrangements according to the invention, the elastically deformable portion can also connect to an outside or an inside surface of the inelastic portion of the top cover, with the connection point or area being spaced inboard from the rim. By this arrangement, a more secure connection might be made between the elastically deformable portion and the inelastic portion of the top cover.

The connection to the outside or inside surface of the inelastic portion of the top cover can be made in any suitable manner, such as by glue connection. However, advantages can be provided for cleaning purposes by having the elastically deformable portion removably connected to the relevant surface of the inelastic portion. Thus, in some forms of the invention, the surface of the inelastic portion to which the elastically deformable portion is attached includes a channel into which a portion of the elastically deformable portion is received and secured. The channel can completely surround the opening across which the elastically deformable portion extends, or channel sections can be provided into which discrete sections of the elastically deformable portion are received and secured. In other forms of the invention, press-fit connections can be made between the elastically deformable portion and the inelastic portion, which can comprise projections on the elastically deformable portion that push into and remain connected within openings formed in the inelastic portion.

The connection to the outside or inside surface of the inelastic portion of the top cover can be made with or without the elastically deformable portion being connected to the rim of the opening in the inelastic portion. In some forms of the invention, the elastically deformable portion is connected to the outside or inside surface of the inelastic portion and the elastically deformable portion extends across the opening of the inelastic portion without connection to the rim of the opening. In other forms of the invention, there is engagement between the elastically deformable portion and the rim of the opening, but the engagement is bearing or touching engagement only. This type of engagement can assist to secure the elastically deformable portion in place.

While the above discussion has referred to the option of the elastically deformable portion connecting to either the outside or inside surface of the inelastic portion of the top cover, the expectation is that the connection, if provided, will normally be made to the inside surface of the inelastic portion. In this arrangement, where the engagement between the elastically deformable portion and the rim of the opening is bearing or touching engagement only, the arrangement can be such that the elastically deformable portion can be connected to inside surface of the inelastic portion and part of that portion can extend into the opening in the inelastic portion and can bear against the facing edge of the rim of the opening.

The elastically deformable portion can be formed as part of a seal that is attached to the inside of the container lid and that seals against surfaces of the container bottom when the lid is in closed connection with the base. The seal can, for example, seal against upper ends or facing edges of the walls of the container bottom as well as the upper ends or facing edges of any partition walls provided within the container bottom interior. The seal can include channels for sealing purposes into which upper ends of the walls of the container bottom and/or any partition walls extend when the lid is in closed connection with the base.

The seal can be attached to the container lid in any suitable manner and can be attached by the same attachment arrangements described above in relation to the connection of the elastically deformable portion to the lid.

The seal can thus include a seal portion and the elastically deformable portion and these two portions can be of the same material so that the seal is a single piece component. The seal portion can extend over the entire base of the container bottom other than the portion of the base that the elastically deformable portion overlies, or, where the container bottom is partitioned, the seal portion can extend over one or more of the compartments. In some forms of the invention, the seal extends over two compartments with the elastically deformable portion overlying one of the compartments and the seal portion overlying the other of the compartments. In one form of the invention, the container bottom includes three compartments and the seal overlies two of the compartments.

The elastically deformable portion can be comprised of two separate substrates, comprising an outer substrate and an inner substrate, each of which extends across the opening of the inelastic portion. In some forms of the invention, the outer substrate can be attached to the rim of the opening and the inner substrate can be attached to an inside or outside surface of the inelastic portion of the top cover, spaced from the rim. The expectation is that the inner substrate would normally be made to the inside surface of the inelastic portion. In this form of the invention, one of the inner substrate and the inside surface of the inelastic portion can define a channel and the other of the inner substrate and the inside surface of the inelastic portion can have a projection for receipt within the channel, whereby receipt of the projection within the channel attaches the inner substrate to the inside surface of the inelastic portion. In other forms of the invention, press-fit connections can be made between the inner substrate and the inside surface of the inelastic portion, which can comprise projections on the inner substrate that push into and remain connected within openings formed in the inelastic portion.

In the above form of the invention, the outer substrate being an overmould and the inner substrate being a removable seal.

BRIEF DESCRIPTION OF DRAWINGS

In order that the invention may be more fully understood, some embodiments will now be described with reference to the figures in which.

DETAILED DESCRIPTION

The accompanying figures show a food container according to one embodiment of the invention. It is to be appreciated however, that the food container 10 of the figures is just one form of container to which the present invention applies.

Figure 1:
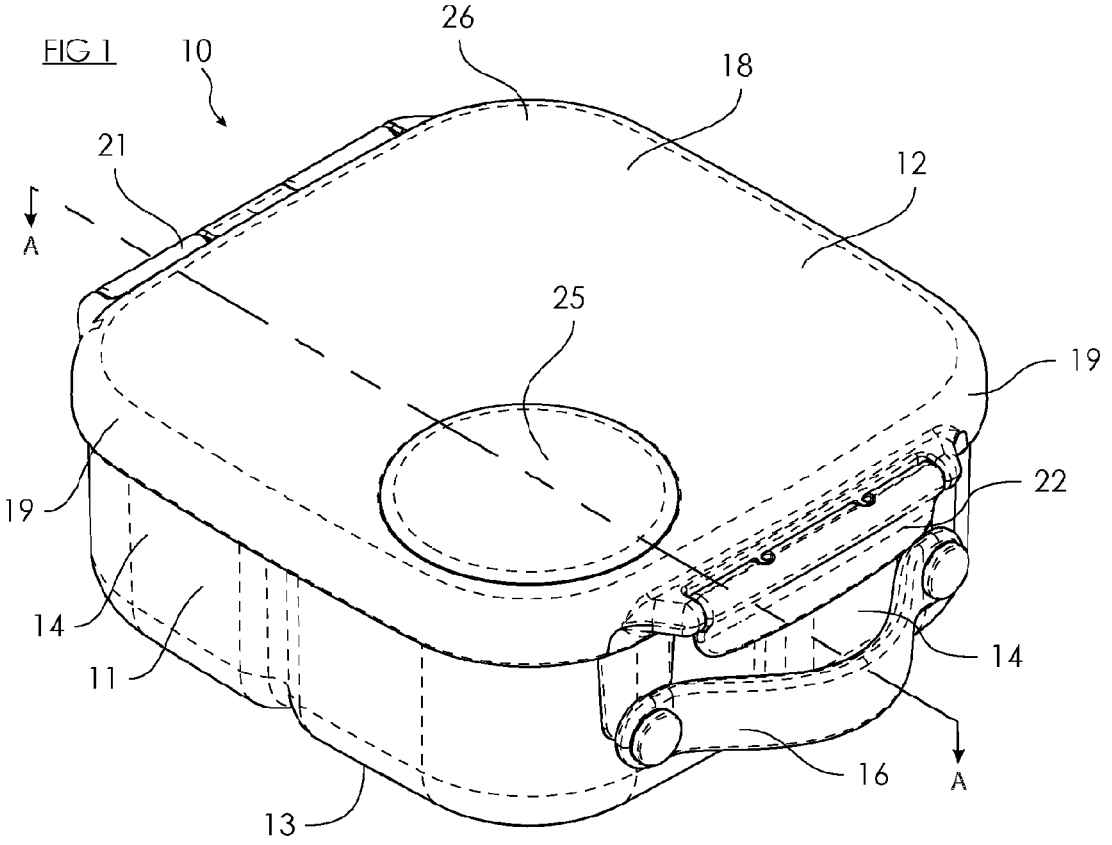
FIG. 1 illustrates a container according to the present invention with the container shown in a closed condition.
Figure 2:
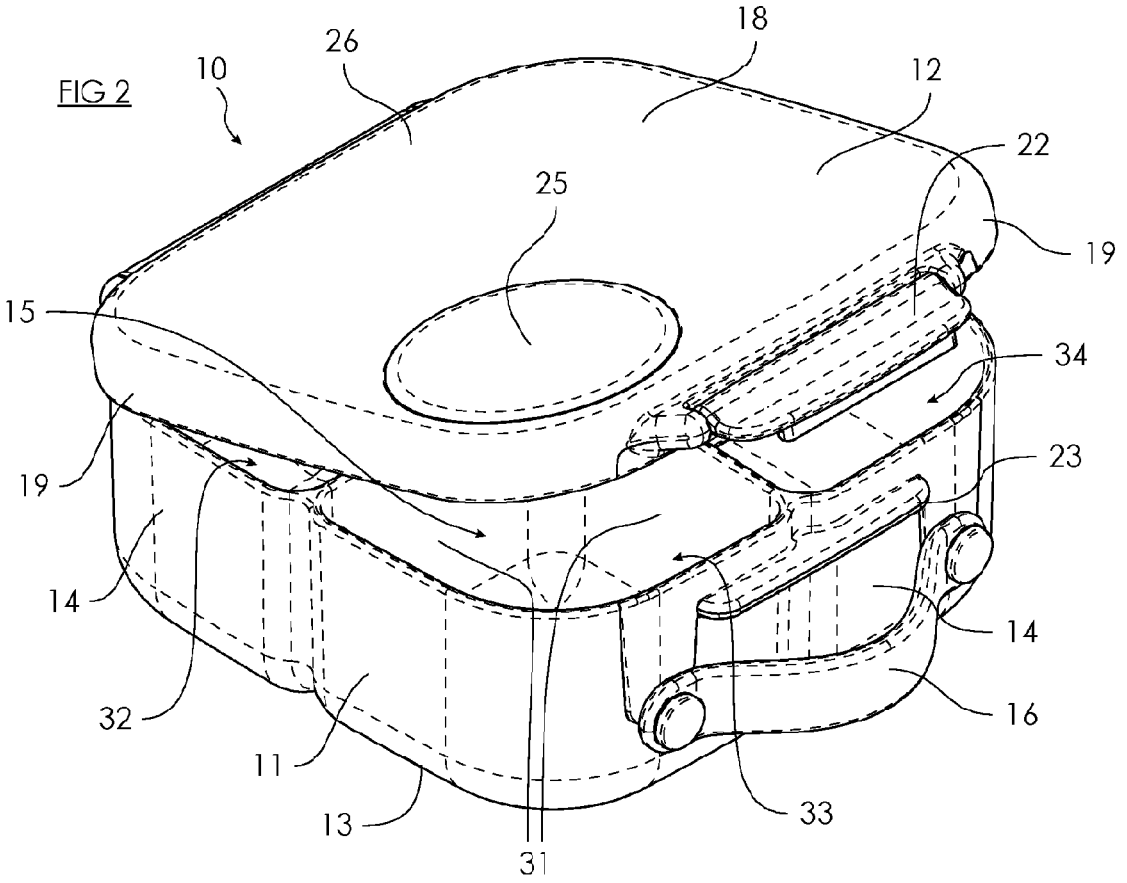
FIG. 2 illustrates the container of FIG. 1 with the lid of the container in a slightly open or ajar position.

The food container of FIGS. 1 and 2 includes a container bottom 11 and a container lid 12. The container bottom 11 has a base 13 from which walls 14 are upstanding. The base 13 and walls 14 define a container bottom interior 15. Fixed to a front wall 14 is a carry strap 16.

The container lid 12 has a rectangular top cover 18 and side edges 19 in which the side edges 19 form a downwardly extending lip about the top cover 18 that in the closed condition of the container 10, overlaps with upper ends of the walls 14. The side edges 19 extend generally perpendicular to the top cover 18.

The lid 12 is connected to the container bottom 11 via a rear hinge 21 and a hinged clip or latch 22, which locks about a projection 23 in the closed condition shown in FIG. 1. It will be readily evident that the container 10 can be opened by a release of the latch 22 from the projection 23 and the lid 12 can rotate upwardly and away from the bottom 11 about the hinge 21.

Figure 3:
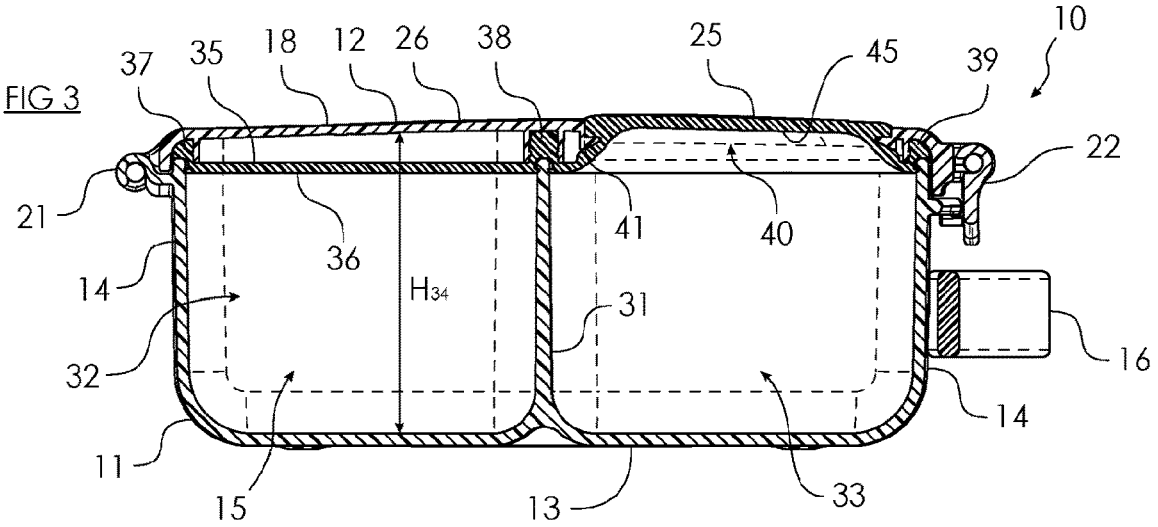
FIG. 3 is a cross-sectional view of the container of FIG. 1 taken through section A-A of FIG. 1.
Figure 4:
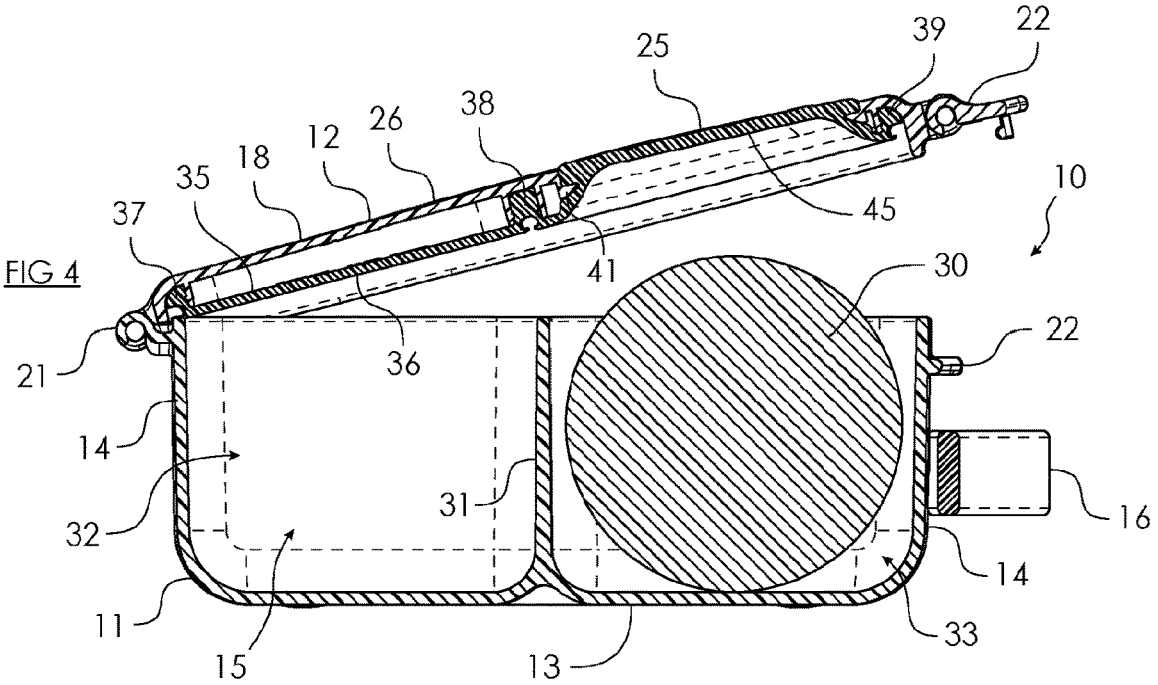
FIG. 4 is a cross-sectional view of the container of FIG. 2 taken through section A-A of FIG. 1 but with lid of the container in a slightly open or ajar position as shown in FIG. 2.
Figure 5:
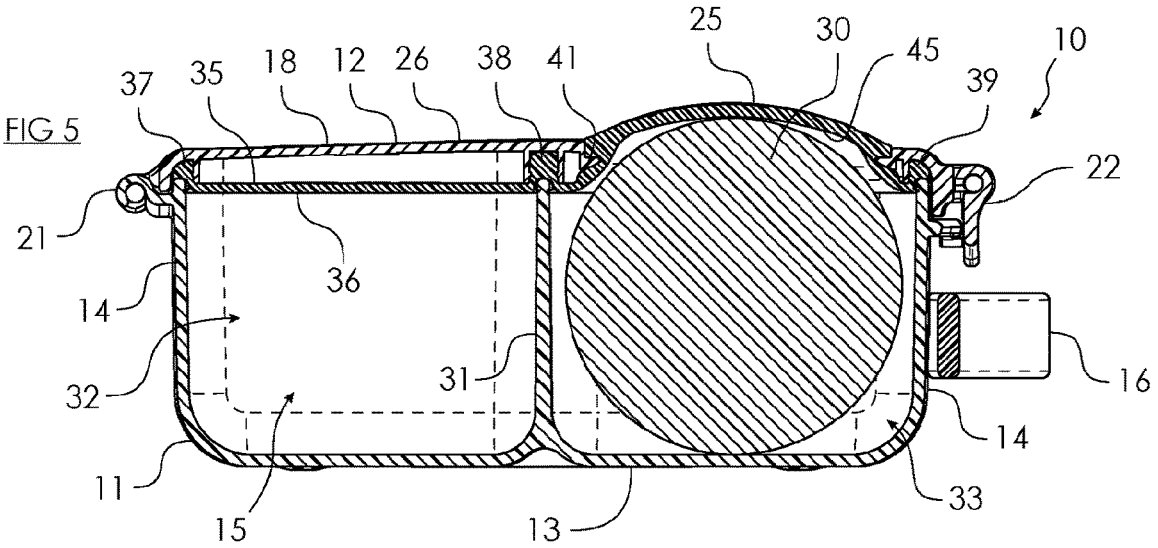
FIG. 5 is a cross-sectional view of the container of FIG. 1 showing the elastically deformable portion being deformed outwardly.

The container 10 includes an elastically deformable portion 25 and an inelastic portion 26. FIGS. 3 to 5 show that the inelastic portion 26 is interrupted at the elastically deformable portion 25. The inelastic portion 26 forms the major part of the top cover 18 in the container 10. As is evident from FIG. 1, in the closed condition of the container 10, the elastically deformable portion 25 and the inelastic portion 26 both overlie the base 13 of the container bottom 11. However, the respective portions 25 and 26 overlie different portions of the base 13.

A cross-sectional view of the container 10 shown in the closed condition of FIG. 1 and taken through section A-A of FIG. 1 is illustrated in FIG. 3. FIGS. 4 and 5 also show the container 10 taken through the section A-A but in FIG. 4, the lid 12 is slightly ajar from the bottom 11, while in FIG. 5, the lid is in the closed condition but shows the elastically deformable portion 25 in an outwardly deformed state. In each of FIGS. 4 and 5, a spherical food item 30, in the form of an apple, is shown within the container bottom interior 15.

Figure 6:
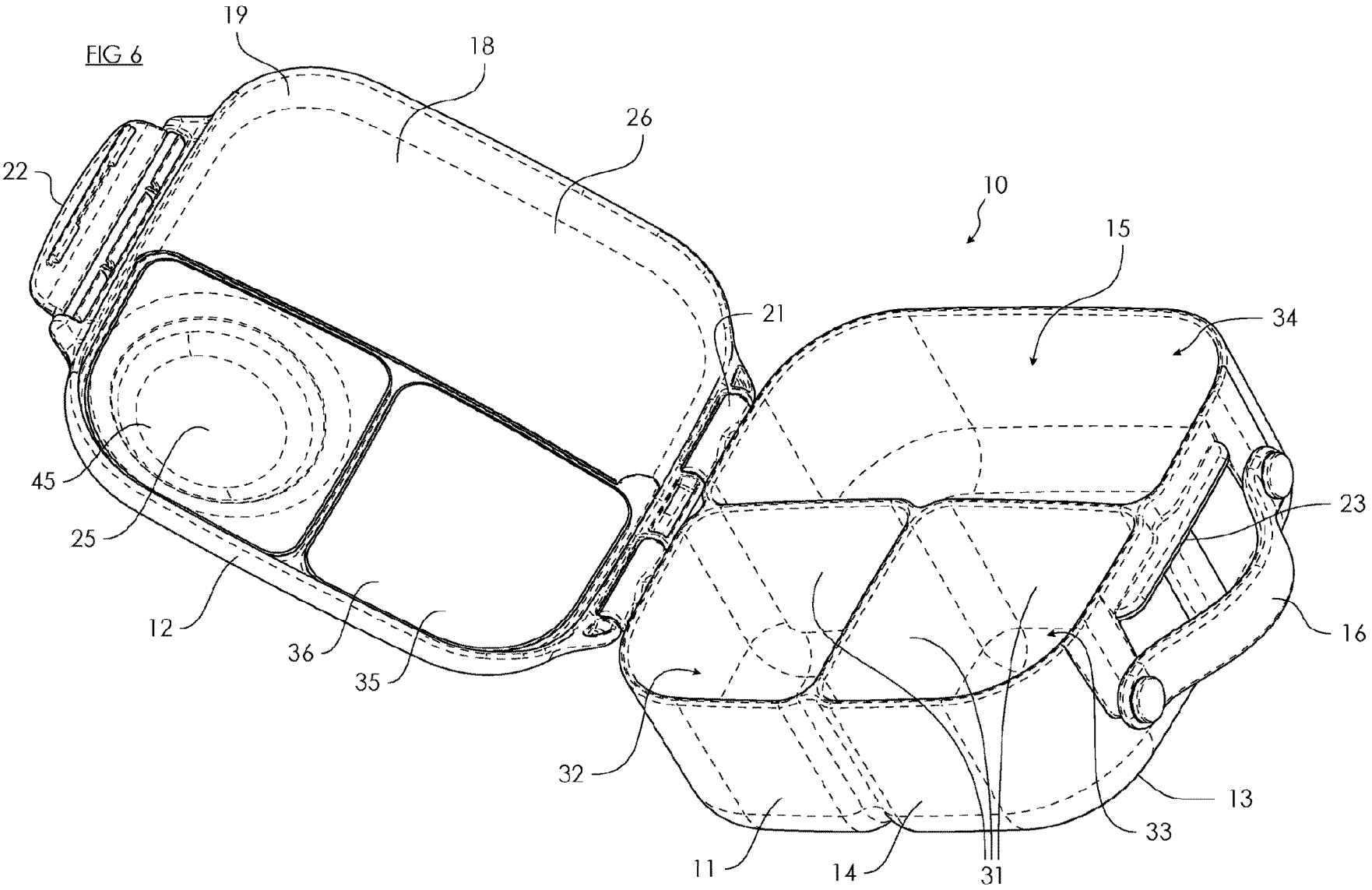
FIG. 6 illustrates the container of FIG. 1 with the lid of the container in a fully open position.

FIG. 6 is a view of the container 10 with the lid 12 fully open relative to the container bottom 11. FIG. 6 illustrates that the container bottom 11 includes partition walls 31 that extend upwardly from the base 13. FIG. 2 also shows the partition walls 31, although they are partly obscured. The container bottom 11 thus forms separate compartments for the separate storage of different food items. While two compartments 32 and 33 are evident from FIGS. 3 to 5, FIG. 6 shows that the container 10 includes three compartments 32 to 34. The compartments 32 and 33 are substantially identical in shape and configuration and are approximately square shaped, while the compartment 34 extends along the side of the container bottom 11 from front to back, to form a single, generally rectangular compartment which is approximately the same size as the combined compartments 32 and 33.

It will be evident from FIGS. 3 to 5, that the elastically deformable portion 25 is part of a larger seal component 35 that extends across and seals over the respective compartments 32 and 33. As shown in FIG. 3, the elastically deformable portion 25 overlies only the compartment 33. Of course, the elastically deformable portion 25 could be arranged to extend over the compartment 32 as well, or a separate elastically deformable portion could be included to extend over that compartment. Accordingly, while the placement of the elastically deformable portion 25 is shown as overlying the compartment 33 in FIG. 3, it is not restricted to that position, or to overlying just a single compartment.

The seal component 35 thus comprises seal portion 36 and the elastically deformable portion 25. The seal portion 36 underlies a section of the inelastic portion 26, while the seal component 35 is secured to the lid 12 by the projections 37, 38 and 39 being received within channels formed in the lid 12. The elastically deformable portion 25 extends through an opening 40 in the inelastic portion 26 of the top cover 18 and engages the rim 41 of the opening 40 within corresponding recesses formed within the external periphery of the elastically deformable portion 25. The opening 40 is a circular opening, so that the rim 41 is a circular rim.

The entire seal component 35 is formed of an elastically deformable material, preferably silicone. Thus, the material of the elastically deformable portion 25 is continued through the seal portion 36 and the respective projections 37, 38 and 39. The seal component 35 is intended to seal against the upper ends or edges of the walls 14 and the partition walls 31 that define the compartments 32 and 33. The seal component 35 does not overlie the compartment 34 and therefore does not seal over that compartment. This arrangement is simply the arrangement adopted as an example to illustrate one form of the present invention, and so different seal configurations can be provided to seal different compartments or all of the compartments that might be provided in a container bottom.

It will be appreciated that in a closed condition of a container 10 such as shown in FIGS. 1, 3 and 5, the maximum height of an item that can be stored in the compartment 34 is the height $H_{34}$. That height is the spacing between the inside surfaces of the lid 12 and the base 13 and with respect to the compartment 34, there is no seal interposed between those surfaces. It follows that the maximum height of an item that can be contained in the compartment 32 is slightly less than in the compartment 34 by virtue of the existence of the seal portion 36. Given that the seal portion 36 is formed of an elastically deformable material, an item that has a height that is greater than the spacing between the inside surface of the base 13 and the facing surface of the seal portion 36 will cause the seal portion 36 to deform towards the lid 12, but deformation will terminate as soon as the seal portion 36 engages the inside surface of the lid 12. It follows, that in respect of the compartments 32 and 34, substantially the same maximum height applies to items that can be stored within those compartments when the lid 12 is closed onto the container bottom 11.

However, the same height restriction does not apply in relation to items that are placed within the compartment 33. As is evident from FIG. 5, a food item 30 that would otherwise not fit within the compartment 32 or 34 by virtue of its height exceeding the height $H_{34}$, can be successfully placed within the compartment 33 and the lid 12 closed over the container bottom 11. This occurs by virtue of the elastically deformable portion 25 deforming elastically outwardly (away from the base 13) as the food item 30 engages the elastically deformable portion 25 as the lid 12 is shifted into closed connection with the container bottom 11.

It is important to understand that while the food item 30 is shown as a spherical item, the elastically deformable portion 25 would deform elastically outwardly on contact with any item within the compartment 33 that exceeds the height that exists between the facing surfaces of the base 13 and the inside surface 45 of the elastically deformable portion 25. Moreover, the elastically deformable portion 25 has a generally planner configuration at all times except upon engagement by an item. Upon engagement, the portion 25 would deform outwardly to accommodate an item within the compartment 33. There will of course be a limit to the extent to which outward deformation of the portion 25 can occur, but the expectation is that items that are placed within the container 10 will usually be of a height which is less than $H_{34}$, or where greater than that height, will only be a small amount greater. That is, the elastically deformable portion 25 is provided to accommodate items that will usually only be just a small amount greater than $H_{34}$.

FIGS. 7 to 10 illustrate different arrangements for forming the elastically deformable portion 25. The arrangements of FIGS. 7 to 11 differ from the manner which the elastically deformable portion 25 is illustrated in FIGS. 3 to 6. FIGS. 7 to 11 each show a portion 50 of an inelastic section of a container lid, and an elastically deformable portion of the lid. Each of the figures shows the elastically deformable portion in two positions, being a resting position (the upper image) and an elastically deformed position (the lower image).

Figure 7:
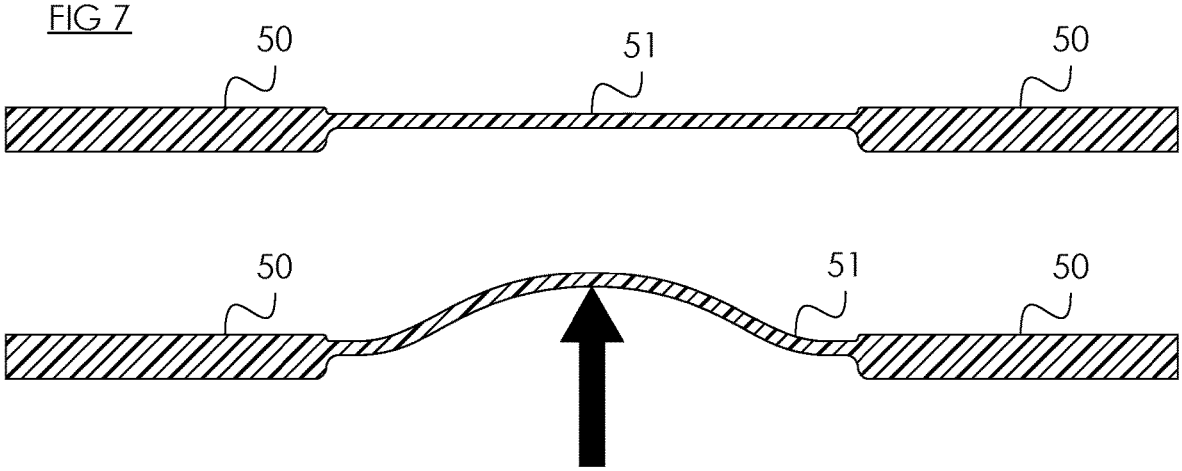
FIGS. 7 to 12 illustrate different arrangements for forming the elastically deformable portion.

With reference to FIG. 7, an integral formation is illustrated showing inelastic portions 50 on either side of an elastically deformable portion 51. The portion 51 is a thinned section of the same material as the inelastic portions 50 and for example, can be formed by creating both of the portions 50 and 51 from polypropylene. As indicated above, the wall thickness of the inelastic portions 50 could be in the region of over 2 to 4 mm, while the wall thickness of the elastically deformable portion 51 could be in the region of 0.2 to 1 mm.

Figure 8:
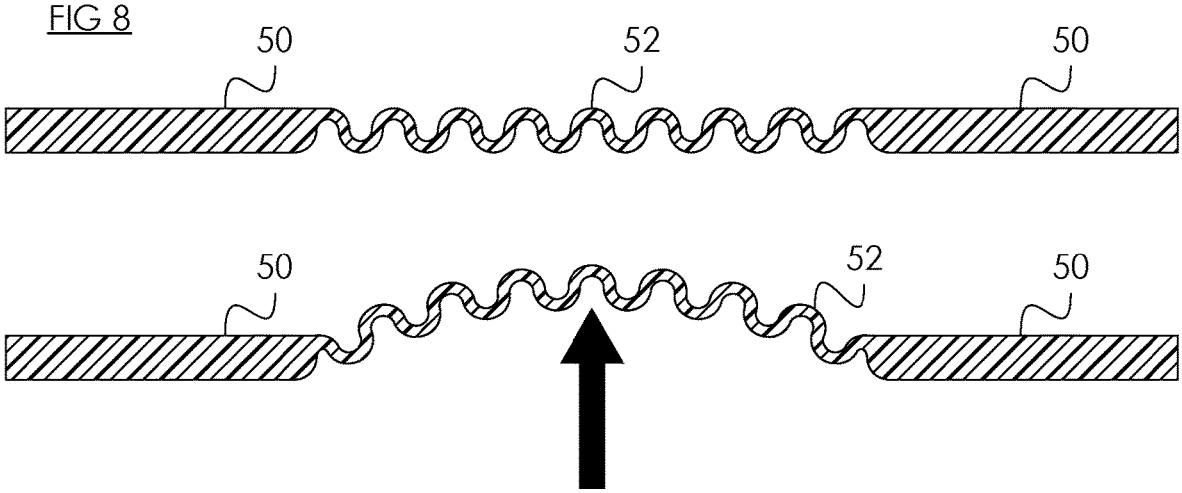

FIG. 8 illustrates a further integral construction but in FIG. 8, the elastically deformable portion is formed from a corrugated section, so that outward elastic deformation is achieved initially by a deformation of the corrugated profile of portion 51 and further deformation can be achieved by straightening out or flattening of the corrugations themselves. Still further deformation can be achieved by elastic stretching of the portion 51 once the corrugations have flattened.

Figure 9:
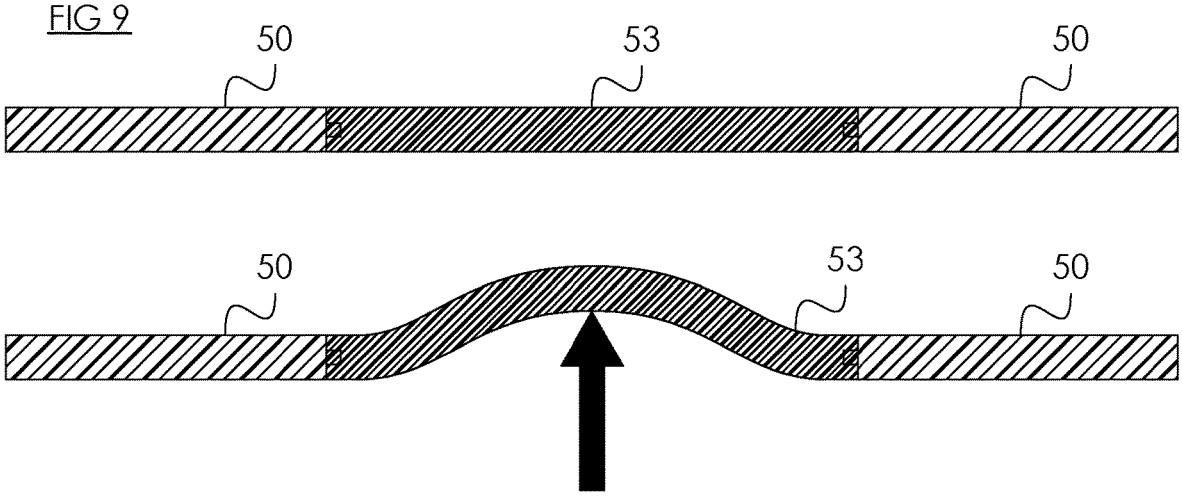

FIG. 9 illustrates an overmoulded arrangement, whereby a TPE (thermoplastic elastomer), or other appropriate soft elastic material, such as TPU (thermoplastic polyurethane) portion 53 is overmoulded with an inelastic plastic material (such as PP—polypropylene) of the portion 50. Opposite edges of the portion 53 connect to facing edges of the portion 50 to form chemical bonds during overmoulding which holds the two materials together.

Figure 10:
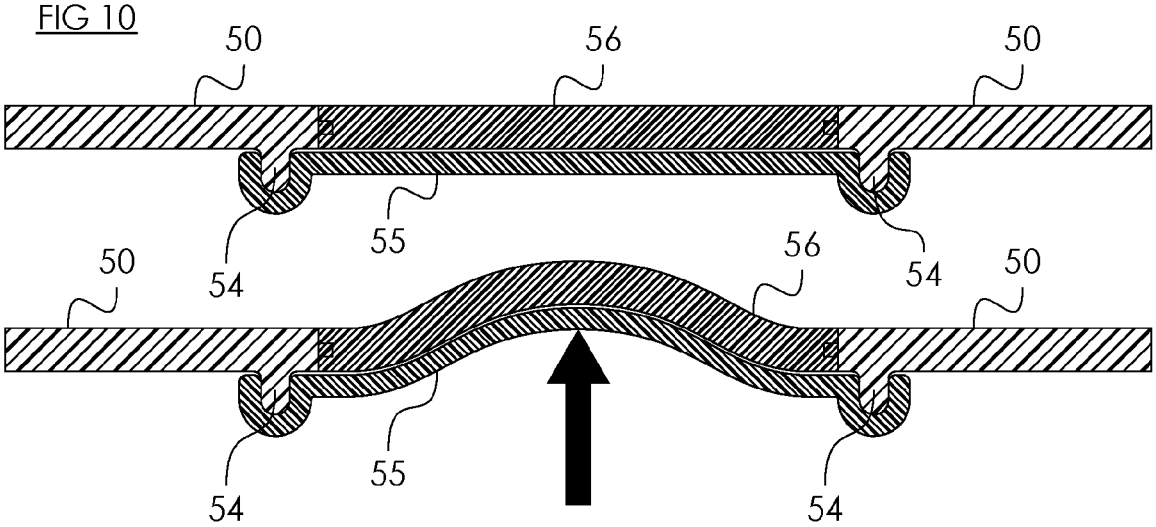

FIG. 10 illustrates an arrangement in which the inelastic portion 50 includes downwardly extending projections 54 onto which is secured an elastically deformable, but removable seal 55. The seal 55 underlies an overmould section 56 that can be moulded to the inelastic portions 50 in the same manner as described above in relation to FIG. 9.

The FIG. 10 arrangement also illustrates how the elastically deformable portion 25 could be applied in the container 10, without the seal portion 36 of the overall seal component 35 also being provided. Thus, in FIG. 3, the elastically deformable portion 25 could terminate at the projection 38 rather than extending into the seal portion 36. In such an arrangement, and with reference also to FIG. 6, only compartment 33 would then be sealed.

Figure 11:
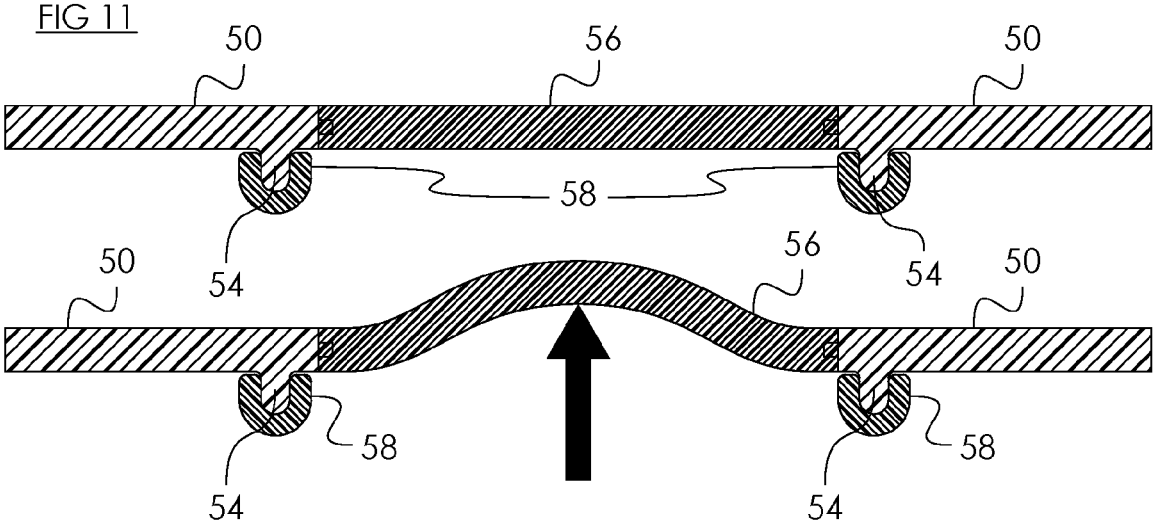

FIG. 11 illustrates a similar arrangement to FIG. 10, so that it shows the inelastic portions 50 and an overmould section 56 connected therebetween, but it also shows a removable peripheral seal 58 applied to the downwardly extending projections 54. The peripheral seal 58 does not underlie the overmould section 56 of FIG. 9, but rather, extends about or surrounds it.

Figure 12:
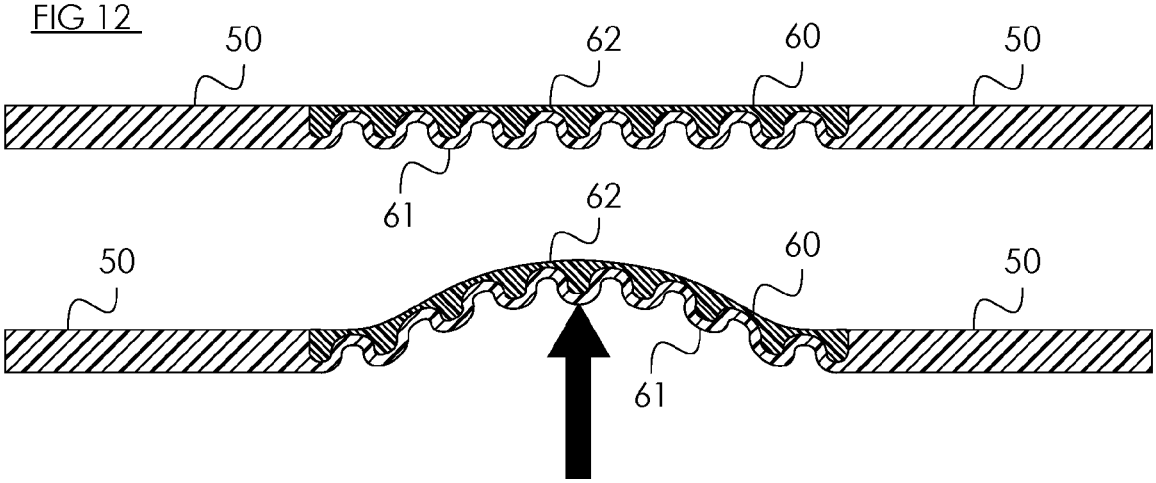

FIG. 12 illustrates a similar arrangement to FIG. 8, so that it shows an integral formation comprising inelastic portions 50 on either side of an elastically deformable portion 60. The portion 60 comprises a thinned section 61 that is integral with and of the same material as the inelastic portions 50. The section 61 is a corrugated section. The portion 60 further comprises an overmould section 62 that is moulded into the corrugations of the upper surface of the section 61. The arrangement of FIG. 12 is such that the overmould section 62 forms an outside surface of the elastically deformable portion 60 and the corrugated section 61 forms an inside surface of the elastically deformable portion 60.

The advantage of this arrangement is most relevant for food grade containers. In those containers, silicone is usually used for surfaces that come into contact with food. However, silicone is more expensive than other materials. But in FIG. 12, a combination of a thin corrugated food grade PP (section 61) is used with an overmoulded TPE (section 62). This reduces the amount of silicone used (because the section 61 is thin) but also facilitates a pleasingly aesthetic look to the outside of the container by the use of the TPE which can be suitably coloured and which is soft to the touch.

Returning to FIGS. 3 and 4, the elastically deformable portion 25 approximately continues the planar upper surface of the inelastic portion 26. While this is aesthetically pleasing, in other forms of the invention, the FIG. 10 arrangement could be adopted but without the overmoulded portion 56. Thus, in the non-deformed state, the elastically deformable portion 55 would extend below the outer surface of the inelastic portion 50, but on engagement with an item, the elastically deformable portion 55 would push through and past the outer surface of the inelastic portion 50 depending on the amount of deformation required to accommodate the item.

The food container 10 advantageously facilitates accommodation of items, such as food items, that have a height that exceeds the height $H_{34}$ of the containment space of the container 10, by the elastically deformable portion 25 elastically deforming outwardly so that the height of the containment space $H_{34}$ is increased.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A food container comprising:

a container bottom, and a container lid, wherein the container bottom has a base and walls upstanding from the base to define a container bottom interior, wherein the container lid has a top cover and side edges, the top cover overlying the base when the container lid is in closed connection with the container bottom, wherein the top cover comprises an inelastic portion that defines an opening and an elastically deformable portion that extends across the opening, each of the elastically deformable portion and the inelastic portion overlying different portions of the base when the container lid is in closed connection with the container bottom, wherein the elastically deformable portion is formed as part of a seal that is attached to an inside of the container lid and seals against surfaces of the container bottom when the container lid is in closed connection with the container bottom, wherein the elastically deformable portion facilitates accommodation of an item within the container bottom interior that rests on a portion of the base that underlies the elastically deformable portion and extends into contact with the elastically deformable portion as the container lid is shifted into closed connection with the container bottom by the elastically deformable portion deforming elastically outwardly away from the base in contact with the item.

2. The food container according to claim 1, wherein the container bottom includes at least one partition wall within the container bottom interior to form at least two compartments and whereby the elastically deformable portion overlies one of the compartments.

3. The food container according to claim 2, wherein the elastically deformable portion overlies two or more of the at least two compartments.

4. The food container according to claim 3, wherein a first elastically deformable portion overlies one of the at least two compartments and a second elastically deformable portion overlies another of the at least two compartments.

5. The food container according to claim 4, wherein the first and second elastically deformable portions are separated by the inelastic portion.

6. The food container according to claim 1, wherein the elastically deformable portion and the inelastic portion of the top cover are formed integrally by the top cover being formed by molding.

7. The food container according to claim 6, wherein the elastically deformable portion of the top cover has a wall thickness which is thinner than the wall thickness of the inelastic portion.

8. The food container according to claim 7, wherein the elastically deformable portion has a generally corrugated cross-section in an absence of contact with the item within the container bottom interior.

9. The food container according to claim 1, wherein the opening is a circular opening.

10. The food container according to claim 1, wherein the opening has a rim and the elastically deformable portion is attached to the rim.

11. The food container according to claim 1, wherein the opening has a rim and the elastically deformable portion is attached to the rim and to an inside surface of the top cover spaced from the rim.

12. The food container according to claim 11, wherein at least a portion of the inside surface of the top cover to which the elastically deformable portion is attached comprises a channel into which a portion of the elastically deformable portion is received and secured.

13. The food container according to claim 1, wherein the seal seals against upper ends of the walls of the container bottom when the container lid is in closed connection with the base.

14. The food container according to claim 13, wherein the seal includes channels into which upper ends of the walls of the container bottom extend when the container lid is in closed connection with the base.

15. The food container according to claim 1, wherein the seal seals against upper ends of at least one partition wall when the container lid is in closed connection with the base.

16. The food container according to claim 15, wherein the seal includes channels into which upper ends of the at least one partition wall extend when the container lid is in closed connection with the base.

17. The food container according to claim 1, wherein the seal seals against upper ends of the walls of the container bottom and with upper ends of at least one partition wall when the container lid is in closed connection with the base.

18. The food container according to claim 17, wherein the seal includes channels into which upper ends of the walls of the container bottom and upper ends of the at least one partition wall extend when the container lid is in closed connection with the base.

19. A food container, comprising:

a container bottom; and a container lid, wherein the container bottom has a base, walls upstanding from the base to define a container bottom interior, and at least one partition wall within the container bottom interior to form at least two compartments, wherein the container lid has a top cover and side edges, the top cover overlying the base when the container lid is in closed connection with the container bottom, wherein the top cover comprises a first elastically deformable portion, a second elastically deformable portion, and an inelastic portion, each of the first elastically deformable portion, the second elastically deformable portion, and the inelastic portion overlying different portions of the base when the container lid is in closed communication with the container bottom, wherein the first elastically deformable portion overlays one of the at least two compartments and the second elastically deformable portion overlays another of the at least two or more compartments when the container lid is in closed connection with the container bottom, and wherein at least one of the first elastically deformable portion or the second elastically deformable portion facilitates accommodation of an item within the container bottom interior that rests on a portion of the base that underlies the at least one of the first elastically deformable portion or the second elastically deformable portion and extends into contact with the at least one of the first elastically deformable portion or the second elastically deformable portion as the container lid is shifted into closed connection with the container bottom by the at least one of the first elastically deformable portion or the second elastically deformable portion deforming elastically outwardly away from the base in contact with the item.

20. A food container, comprising:

a container bottom, and a container lid, wherein the container bottom has a base and walls upstanding from the base to define a container bottom interior, wherein the container lid has a top cover and side edges, the top cover overlying the base when the container lid is in closed connection with the container bottom, wherein the top cover comprises an inelastic portion that defines an opening and an elastically deformable portion that extends across the opening, each of the elastically deformable portion and the inelastic portion overlying different portions of the base when the container lid is in closed connection with the container bottom, wherein the opening has a rim, the elastically deformable portion is attached to the rim and to an inside surface of the top cover spaced from the rim, wherein at least a portion of the inside surface of the top cover to which the elastically deformable portion is attached comprises a channel into which a portion of the elastically deformable portion is received and secured, wherein the elastically deformable portion facilitates accommodation of an item within the container bottom interior that rests on a portion of the base that underlies the elastically deformable portion and extends into contact with the elastically deformable portion as the container lid is shifted into closed connection with the container bottom by the elastically deformable portion deforming elastically outwardly away from the base in contact with the item.

* * * * *